US005433163A

United States Patent [19]

McKiernan

[11] Patent Number: 5,433,163

[45] Date of Patent: Jul. 18, 1995

[54] PUMP OUT ADAPTOR

[75] Inventor: Edward F. McKiernan, Big Prairie, Ohio

[73] Assignee: Sealand Technology, Inc., Big Prairie, Ohio

[21] Appl. No.: 70,254

[22] Filed: Jun. 2, 1993

[51] Int. Cl.[6] ..... B63B 35/00

[52] U.S. Cl. ..... 114/270; 141/383; 285/12; 285/117; 285/175; 285/332; 285/312

[58] Field of Search ..... 285/12, 117, 311, 175, 285/312, 332; 114/26, 179, 180, 183 R, 221 R, 270; 417/900; 141/284, 383

[56] References Cited

U.S. PATENT DOCUMENTS

| | | | |
|---|---|---|---|
| 1,325,826 | 12/1919 | Baka et al. | 285/311 |
| 3,116,943 | 1/1964 | Wagner | 285/312 |
| 3,528,462 | 9/1970 | Ouase | 141/285 |
| 3,820,488 | 6/1974 | Johnson | 114/270 |
| 4,295,670 | 10/1981 | Goodall et al. | 285/312 X |
| 4,722,556 | 2/1988 | Todd | 285/12 |
| 5,165,727 | 11/1992 | Valley | 285/12 |

FOREIGN PATENT DOCUMENTS

| | | | |
|---|---|---|---|
| 1192585 | 8/1985 | Canada | 285/312 |

OTHER PUBLICATIONS

Known adaptor for receiving rubber right circular cone frustrum nozzles; admitted prior art.

Known BANJO adaptor for receiving cam lever coupling nozzles; admitted prior art.

*Primary Examiner*—Dave W. Arola

*Attorney, Agent, or Firm*—Nixon & Vanderhye

[57] ABSTRACT

An adaptor for use with dockside pumps to facilitate pump out of sewage holding tanks is constructed so that it readily accommodates both of the two most common fittings for dockside pumps, an elastomeric material right circular cone frustrum, and a cam actuated fitting having a number of curved locking surface locking cams. The adaptor is a tubular body of rigid material having first and second ends with a concentric bore. An interior surface of the first end defines a cone frustrum cooperable with the dockside pump cone frustrum fitting, and the exterior surface of the first end is a cylindrical surface with a semi-toroidal recess at a central axial portion, which recess cooperates with the curved surfaces of the locking cams. The second end of the adaptor has external threads that fit one of three common sizes of boat deck fitting internal threads (e.g. a nominal diameter of 1¼ inches and 11½ threads per inch), and an annular flexible sealing ring can be provided between the threads and a collar of the adaptor.

15 Claims, 2 Drawing Sheets

PUMP OUT ADAPTOR

BACKGROUND AND SUMMARY OF THE INVENTION

A common way of emptying sewage holding tanks on boats is to pump the sewage out of the holding tank using a dockside pump. In order to effectively practice this function it is important to have an air tight fit between the dockside pump out station and the boat waste deck fitting. In an attempt to facilitate this, the United States Coast Guard has promulgated regulations which require a 1½ inch nominal internal pipe thread. However because exactly what a "1½ inch nominal internal pipe thread" is cannot be clearly discerned from the regulations, it has been found—according to the invention—that three different deck fitting internal thread configurations are commonly provided on boats. It has also been determined according to the present invention that dockside pump out stations typically have one of two very different fittings, one which comprises a rubber (elastomeric material) right circular cone frustrum nozzle, and the other a fuel line type fitting, which is cam actuated, having a plurality of (typically two) curved locking surface locking cams.

While some adaptors presently exist to match the nozzle type dockside pump hose fittings, and others are available to match the cam actuated type, there are no universal adaptors. Requiring a marina to have pump out adaptors for every style of waste deck fitting is not practical, however if an adaptor were utilized on a boat which matched the waste deck fitting threads of that boat and was capable of air tight connection to the nozzle or cam actuated type of pump out hose fittings, practical pump out could be more universally effected. From the standpoint of the manufacturer of adaptors, this also would be practical since, according to the invention, it has been determined that only three different types of adaptors need be provided to accommodate the vast majority of deck fittings.

According to the a first aspect of the present invention, a pump out adaptor is provided. The adaptor comprises the following elements: A generally tubular body of rigid material, having a first end and a second end, with a through extending bore defining an axis substantially concentric with the first and second ends, and having an exterior and interior surface at the first end, and an exterior and interior surface at the second end. The interior surface of the first end defining a frustrum of a right circular cone, so that the bore at the first end has a gradually decreasing diameter from the first end toward the second end. The exterior surface of the second end having external screw threads. And, the exterior surface of the first end comprising a cylindrical surface with a semi-toroidal recess at a central axial portion thereof.

The external screw threads need only be one of three different types. One type has a nominal diameter of 1¼ inches and 11½ threads per inch (in this case the nominal diameter including a major maximum diameter of 1.59 inches and a minor maximum diameter of 1.49 inches, and a maximum pitch diameter of about 1.55 inches). The second one has a 1½ inch nominal diameter and 16 threads per inch (in this case a 1¼ inch nominal diameter comprising a major maximum diameter of about 1.62 inches, and a minor maximum diameter of about 1.56 inches, and a maximum pitch diameter of about 1.58 inches). The third has a 1½ inch nominal diameter and 11½ threads per inch (in this case a 1½ inch nominal diameter meaning a major maximum diameter of about 1.88 inches, a minor maximum diameter of about 1.77 inches, and a maximum pitch diameter of about 1.82 inches).

The purpose of the semi-toroidal recess of the exterior surface of the first end of the adaptor is to cooperate with the curved surfaces of the locking cams on the fuel line type dockside pump hose fitting. Typically in order to do this the minimum diameter of the adaptor at the toroidal recess is about 1.7 inches, with the recess itself having a radius of about 0.3–0.6 inches. The purpose of the interior surface of the first end is to mate with the rubber nozzle type of dockside pump hose, and for this purpose the interior surface makes an angle of about 3°—8° (e.g. 5½°) with respect to the axis of the bore.

It is also desirable to provide a collar on the tubular body between the first and second ends thereof, which collar may have a plurality (e.g. three) of radially extending projections. At least one of the projections may have an opening in it, extending generally tangentially to the collar, such as for receipt of a clip or chain link so as to prevent ready removal of the adaptor from the deck fitting. Also a flexible sealing material (e.g. synthetic or natural rubber) annular ring may be provided between the collar and the external threads at the second end of the adaptor.

According to another aspect of the invention a system for connecting a dockside pump to a boat waste deck fitting to allow removal of waste from a boat sewage holding tank is provided. The system comprises the following elements: A dockside pump, connected by a hose to a fitting, the fitting selected from the group consisting essentially of an elastomeric material right circular cone frustrum, and a cam actuated fitting having a plurality of curved locking surface locking cams. A deck fitting on a boat connected to a sewage holding tank of the boat, the deck fitting having an internally threaded passage. And, an adaptor having first and second ends, and a through extending bore between the ends and substantially concentric therewith, the first end including means capable of positive sealed connection to both of the cone frustrum and locking cam fittings, and the second end comprising external screw threads cooperable with the deck fitting internally threaded passage.

According to yet another aspect of the present invention a method of efficiently pumping out sewage from a boat holding tank, the boat having a deck fitting with an internally threaded passageway, using a dockside pump connected to one end of a hose, which in turn is connected at another end thereof to a fitting, is provided. The method comprises the following steps: (a) Determining the two-five most common sizes for deck internally threaded passages. (b) Constructing two-five adaptors, each adaptor having a first end which can be connected with a positive seal to more than one type of dockside pump hose fitting, and a second end which cooperates with one of the common sizes of internally threaded passage, so as to provide one adaptor for each common size of deck internally threaded passage. (c) Attaching the second end of the appropriate one of the adaptors to a cooperating deck internally threaded passage. (d) Attaching the first end of the adaptor to a dockside pump hose fitting. And, (e) pumping the sewage out of the holding tank through the hose, dockside and deck fittings, and adaptor. In practicing the method the dockside pump hose fitting is typically selected from the group consisting essentially of an elastomeric material right circular cone frustrum, and a cam actuated fitting having a plurality of curved locking surface locking cams; and step (d) is practiced by inserting the right circular cone frustrum fitting into a right circular cone opening in the adaptor, or by bringing the locking cams into contact with cooperating recesses on an external portion of the adaptor.

It is the primary object of the present invention to provide for the practical adaptation of waste deck fittings to dockside pump hose fittings to facilitate the air tight suctioning of a boat holding tank contents off the boat. This and other objects of the invention will become clear from an inspection of the detailed description of the invention, and from the appended claims.

DETAILED DESCRIPTION OF THE DRAWINGS

Figure 1:
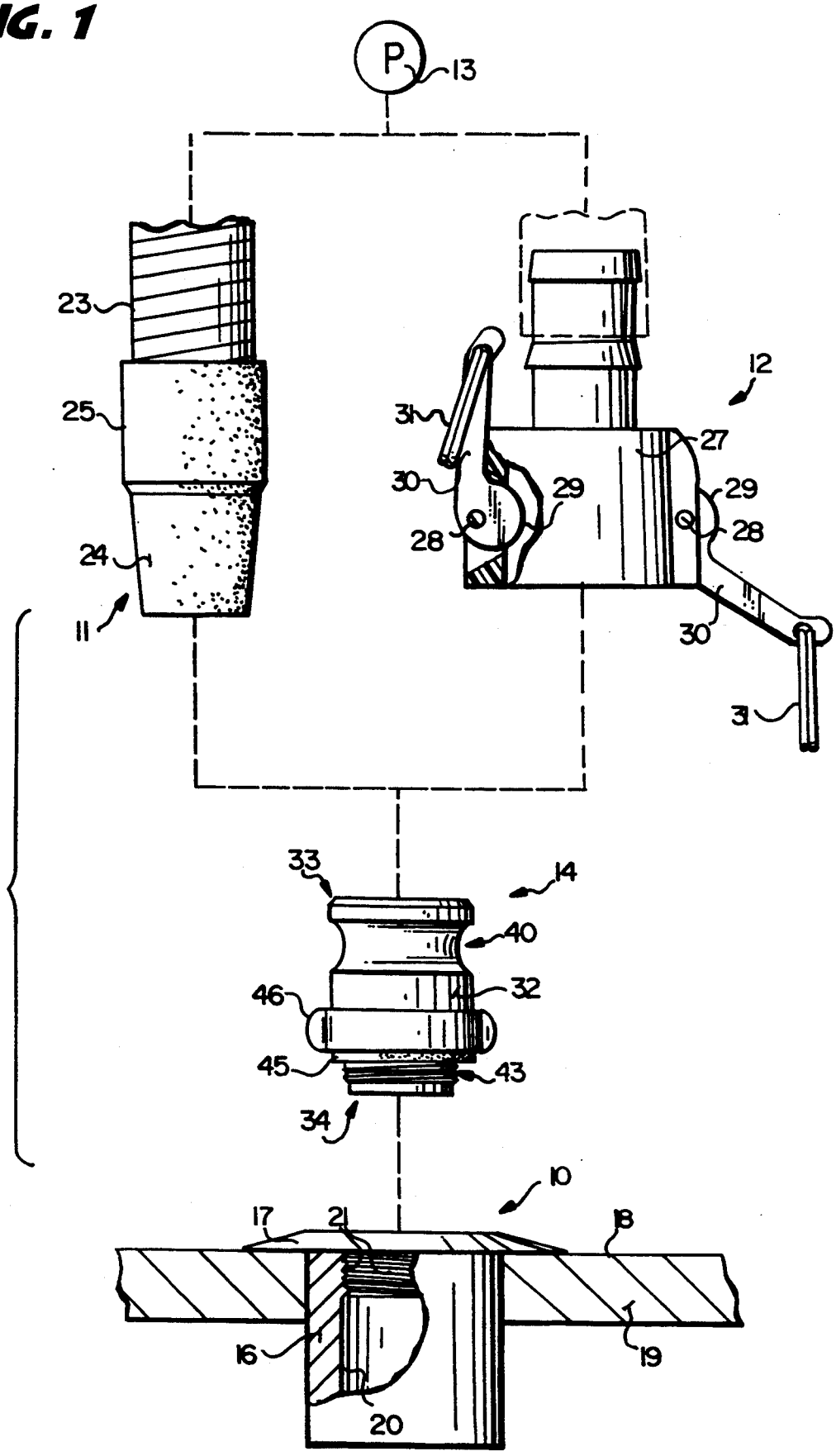
FIG. 1 is an exploded view showing the connection of an exemplary adaptor according to the present invention to a deck side fitting and to one of two hose fittings for a dockside pump.

FIG. 1 illustrates the major component of an exemplary system according to the present invention. The conventional components comprise a waste deck fitting 10, and two alternative types of hose fittings 11, 12, respectively which may be connected to a dockside pump 13. New according to the invention is the adaptor 14 illustrated in FIGS. 1 through 3.

The waste deck fitting 10 comprises a metal or hard plastic tubular element 16 having a flange 17 which engages the top 18 of a boat deck 19, and it has an internal passage 20 that is screw threaded, as indicated by the threads 21 in FIG. 1.

The fitting 11 is of the nozzle type, connected to one end of a hose 23, and preferably is of rubber or a like elastomeric material, and has a right circular cone frustrum 24, which typically includes a built in check valve, and is integral with the circular in cross-section rubber tube 25. The other end of the hose 23 is connected to the dockside pump 13.

For the alternative, somewhat less common at the present time, dockside fitting 12, the main tubular body 27 thereof (typically of hard plastic or metal) has pivotally mounted thereto, as indicated by pivot pins 28, a plurality of (typically two) curved locking surface 29 locking cams. The curved locking surface 29 for the left hand cam is seen in FIG. 1, but only an extended portion thereof is visible for the right hand cam. Each of the cams includes a lever 30 integral therewith, which may have a wire ring 31 at an end thereof opposite the pivot 28.

The adaptor 14 according to the present invention includes a main body 32 (see FIGS. 1 and 2) having a first end 33 and a second end 34. The first end 33 has an external surface 35 and an internal surface 36, while the second end 34 has an external surface 37 and an internal surface 38. The internal surface 36 of the first end 33 defines the frustrum of a right circular cone, having substantially the same taper as the nozzle frustrum 24. For example, the decreasing diameter (from end 33 to end 34) taper of the surface 36 may be about 3°–8° (e.g. about 5½°).

The first end 33 external surface 35 comprises a cylindrical surface with a semi-toroidal recess 40 at a central axial portion thereof. The recess 40 is designed and dimensioned so as to receive the curved locking surfaces 29 of the fitting 12, and typically the smallest diameter of the adaptor 14 at the recess 40 is about 1.7 inches, and the recess 40 itself has a radius of about 0.3–0.6 (e.g. 0.44) inches in order to accommodate the conventional locking cam curved surfaces 29.

Figure 3:
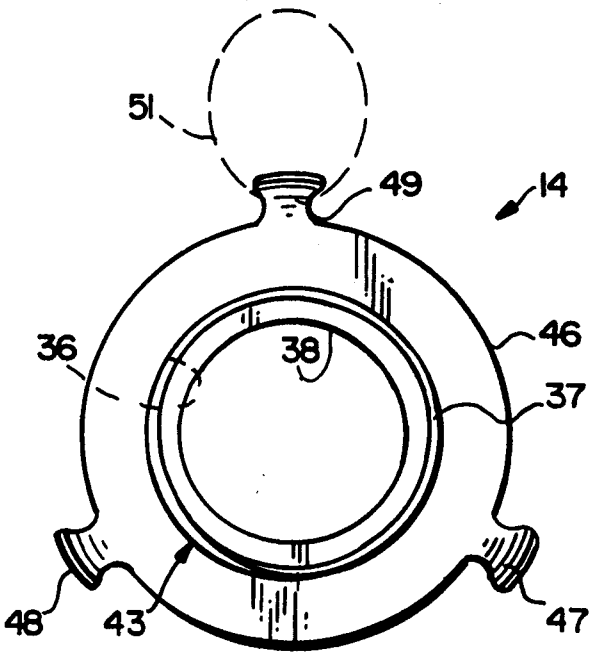
FIG. 3 is a top plan view of the adaptor of FIG. 2.
Figure 2:
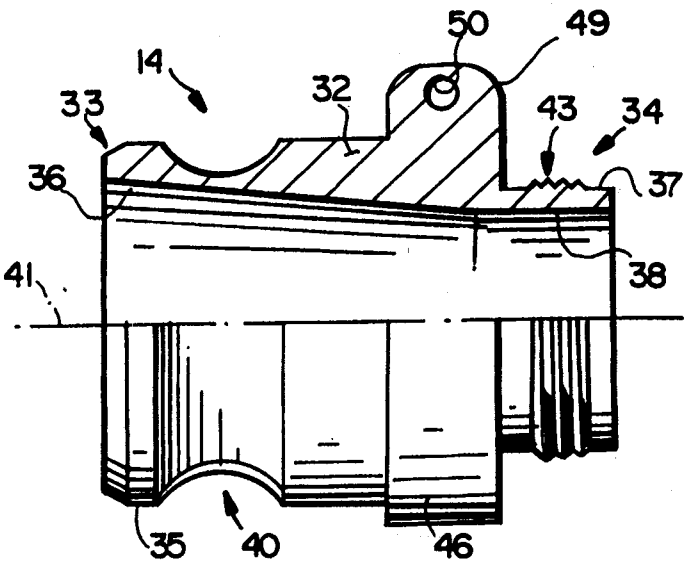
FIG. 2 is a side view of the adaptor of FIG. 1, with the sealing ring removed for clarity of illustration, partly in cross-section and partly in elevation.

The body 32, of metal or rigid plastic, has—as easily seen in FIGS. 2 and 3—a through-extending bore, defined by the surfaces 36, 38, with a central axis 41, substantially concentric with the first and second ends 33, 34.

The second end 34 of the adaptor 14 has external screw threads 43. The external screw threads 43 mate properly with the internal threads 21 of the deck fitting 10. It has been found according to the invention that only three different adaptors 14 are necessary, having three different thread configurations 43, in order to accommodate the vast majority of deck fittings. One type has a nominal diameter of 1¼ inches and 11½ threads per inch (in this case the nominal diameter including a major maximum diameter of 1.59 inches and a minor maximum diameter of 1.49 inches, and a maximum pitch diameter of about 1.55 inches). The second one has a 1½ inch nominal diameter and 16 threads per inch (in this case a 1¼ inch nominal diameter comprising a major maximum diameter of about 1.62 inches, and a minor maximum diameter of about 1.56 inches, and a maximum pitch diameter of about 1.58 inches). The third has a 1½ inch nominal diameter and 11½ threads per inch (in this case a 1½ inch nominal diameter meaning a major maximum diameter of about 1.88 inches, a minor maximum diameter of about 1.77 inches, and a maximum pitch diameter of about 1.82 inches).

Also, as seen in FIG. 1, an annular sealing ring 45 is preferably provided associated with the adaptor 14, the ring 45 being of natural or synthetic rubber, or a like resilient elastomeric material. The ring 45 is provided between the threads 43 and the collar 46, the collar 46 being between the first and second ends 33, 34 of the adaptor 14.

Preferably the collar 46 has a plurality of radially extending projections, such as the projections 47, 48, and 49 (see FIGS. 2 and 3 in particular) extending therefrom. These projections facilitate screwing down action of the adaptor 14, into association with the deck fitting 10. Also, at least one of the projections—e.g. the projection 49—may have a through extending opening 50 (see FIG. 2) therein, which opening 50 is substantially tangent to the collar 46. The opening 50 is adapted to receive a clip, a link of a chain—shown in dotted line at 51 in FIG. 3—or the like, so as to effectively connect the adaptor 14 to the deck 19 so that even if it is unscrewed from the fitting 10 it cannot be removed from the boat, or lost.

It will thus be seen that according to the present invention that by providing only three different adaptors, each having substantially the same first end 33, and differing only in the exact dimensions and other specifications of the screw threading 43 at the second end 34, can accommodate almost all waste deck fittings and dockside pump hose fittings in the United States today. While the invention has been herein shown and described in what is presently conceived to be the most practical and preferred embodiment it will be apparent to those of ordinary skill in the art that many modifications may be made thereof within the scope of the invention, which scope is to be accorded the broadest interpretation of the appended claims so as to encompass all equivalent structures and procedures.

What is claimed is:

1. A system for connecting a dockside pump to a boat waste deck fitting to allow removal of waste from a boat sewage holding tank, comprising:

a dockside pump, connected by a hose to a fitting, said fitting selected from the group consisting essentially of an elastomeric material right circular cone frustrum, and a cam actuated fitting having a plurality of curved locking surface locking cams;

a deck fitting on a boat connected to a sewage holding tank of the boat, said deck fitting having an internally threaded passage; and an adaptor having first and second ends, and a through extending bore between said ends and substantially concentric therewith, said first end including means capable of positive sealed connection to both of said cone frustrum and locking cam fittings, and said second end comprising external screw threads cooperable with said deck fitting internally threaded passage.

2. A system as recited in claim 1 wherein said adaptor comprises a generally tubular body of rigid material, and wherein said first end thereof has exterior and interior surfaces, and said second end thereof has exterior and interior surfaces; and wherein said means capable of positive sealed connection to both of said cone frustrum and locking cam fittings comprises said interior surface of said first end defining a frustrum of a right circular cone having substantially the same angle of taper as said fitting right circular cone frustrum, and said exterior surface of said first end, comprising a cylindrical surface with a semi-toroidal recess at a central axial portion thereof.

3. A system as recited in claim 2 wherein said adaptor tubular body at said semi-toroidal recess has a diameter of roughly about 1.7 inches, and wherein said recess itself has a radius of between about 0.3 and 0.6 inches.

4. A system as recited in claim 3 wherein said frustrum of a right circular cone has an angle of taper of about 3°–8° with respect to said axis.

5. A system as recited in claim 4 further comprising an enlarged diameter collar between said first and second ends.

6. A system as recited in claim 5 further comprising an annular ring of resilient sealing material between said collar and said external screw threads of said second end.

7. A system as recited in claim 2 wherein said adaptor further comprises an enlarged diameter collar between said first and second ends.

8. A system as recited in claim 7 further comprising a plurality of radially outwardly extending projections formed on said collar.

9. A system as recited in claim 8 wherein said adaptor further comprises a through-ending opening in one of said collars, said opening extending generally at a tangent to said collar.

10. A system as recited in claim 7 further comprising an annular ring of resilient sealing material between said collar and said external screw threads of said second end.

11. A system as recited in claim 1 wherein said external screw threads are selected from the group consisting essentially of a nominal diameter of one and one-quarter inches and eleven and one-half threads per inch, a nominal diameter of one and one-quarter inches and sixteen threads per inch, and a nominal diameter of one and one-half inches and eleven and one-half threads per inch.

12. A system as recited in claim 11 wherein said adaptor tubular body at said semi-toroidal recess has a diameter of roughly about 1.7 inches, and wherein said recess itself has a radius of between about 0.3 and 0.6 inches.

13. A system as recited in claim 12 wherein said frustrum of a right circular cone has an angle of taper of about 3°–8° with respect to said axis.

14. A method of efficiently pumping out sewage from a boat holding tank, the boat having a deck fitting with an internally threaded passage, using a dockside pump connected to one end of a hose, which in turn is connected at another end thereof to a fitting, comprising the steps of:

(a) determining the three or more most common sizes for deck internally threaded passages;

(b) constructing two-five adaptors, each adaptor having a first end which can be connected with a positive seal to more than one type of dockside pump hose fitting, and a second end which cooperates with one of said common sizes of internally threaded passage, so as to provide one adaptor for each common size of deck internally threaded passage;

(c) attaching the second end of the appropriate one of said adaptors to a cooperating deck internally threaded passage;

(d) attaching the first end of the adaptor to a dockside pump hose fitting; and (e) pumping the sewage out of the holding tank through the hose, dockside and deck fittings, and adaptor.

15. A method as recited in claim 14 wherein the dockside pump hose fitting is selected from the group consisting essentially of an elastomeric material right circular cone frustrum, and a cam actuated fitting having a plurality of curved locking surface locking cams; and wherein step (d) is practiced by inserting the right circular cone frustrum fitting into a right circular cone opening in the adaptor, or by bringing the locking cams into contact with cooperating recesses on an external portion of the adaptor.

* * * * *